US005168137A

United States Patent [19]

Hufnagel et al.

[11] Patent Number: 5,168,137

[45] Date of Patent: Dec. 1, 1992

[54] MANUALLY OPERABLE CIRCUIT BREAKER

[75] Inventors: Friedrich Hufnagel, Sulzbach-Rosenberg; Georg Weidner, Amberg, both of Fed. Rep. of Germany

[73] Assignee: Siemmens Aktiengesellschaft, Berlin & Munich, Fed. Rep. of Germany

[21] Appl. No.: 516,269

[22] Filed: Apr. 30, 1990

[30] Foreign Application Priority Data

May 2, 1989 [DE] Fed. Rep. of Germany ... 8905506[U]

[51] Int. Cl.[5] ..... H01H 9/20

[52] U.S. Cl. ..... 200/50 R

[58] Field of Search ..... 200/43.11, 43.14, 43.16, 200/43.19, 43.21, 50 B, 50 R, 50 A

[56] References Cited

U.S. PATENT DOCUMENTS

| | | | |
|---|---|---|---|
| 2,883,491 | 4/1959 | Edmunds . | |
| 4,786,885 | 11/1988 | Morris et al. | 335/202 |
| 4,794,356 | 12/1988 | Yu et al. | 335/13 |
| 4,858,056 | 8/1989 | Russell | 361/93 |
| 4,884,048 | 11/1989 | Castonguay et al. | 335/18 |

*Primary Examiner*—A. D. Pellinen
*Assistant Examiner*—Michael A. Friedhofer
*Attorney, Agent, or Firm*—Kenyon & Kenyon

[57] ABSTRACT

A manually operable circuit breaker having coupling terminals and a visible isolating gap which can be established only when the protective circuit breaker is open. The isolating gap is provided by an isolating module which is mountable on coupling terminals of the circuit breaker. The isolating module contains a removable isolating unit. The isolating unit can be removed only when the protective circuit breaker is open. In this way, the circuit breaker is provided with a visible isolating gap only when required.

20 Claims, 6 Drawing Sheets

MANUALLY OPERABLE CIRCUIT BREAKER

FIELD OF THE INVENTION

The present invention relates generally to manually operable circuit breakers and more specifically to circuit breakers having coupling terminals and a visible isolating gap which can be established only when the circuit breaker is open.

BACKGROUND OF THE INVENTION

A manually operable circuit breaker is known (DE-OS 36 42 719) in which the entire overcurrent tripping unit is inserted as a plug-in module into mating terminals on the base of the circuit breaker to produce a visible isolating gap. The overcurrent tripping unit is interlocked by means of a finger-grip knob on the circuit breaker such that the overcurrent tripping unit can only be removed when the circuit breaker is open. This known circuit breaker involves a special design. Since visible isolating gaps are neither necessary nor desirable in every case, the design of this known circuit breaker is relatively complex.

There is therefore a need for a circuit breaker which provides a visible isolating gap without the need to considerably alter the design of a conventional circuit breaker.

SUMMARY OF THE INVENTION

This and other needs are met by the present invention which provides a circuit breaker with an isolating gap in an isolating module. The isolating module has a removable isolating unit and can be mounted onto coupling terminals of the circuit breaker. There are means provided to allow the removal of the isolating unit only when the circuit breaker is open and means provided to permit operation of the coupling terminals only when the circuit breaker is open.

In order to be able to use a conventional contact bridge to bridge the isolating gap, an embodiment of the present invention provides an isolating unit that includes the contact bridge. In this embodiment, the mating terminals in the isolating module can be simple, bent busbars.

To ensure that the isolating gap can be established only when the breaker switch is open, an embodiment of the present invention provides for the isolating unit, the coupling terminals for the isolating module and a manually operable element for the circuit breaker to all operate interdependently via a bolt. In an embodiment of the invention, the manually operated element is a toggle and the bolt is a slidable locking bar having openings to release the coupling terminals. In this case, the coupling terminals are screws. In order to prevent unauthorized persons from switching on the circuit breaker when the isolating unit is removed, an embodiment of the invention provides means for locking or sealing the bolt.

In one embodiment of the invention, a grounding unit replaces the isolating unit to short-circuit the load side and to connect a ground line. This grounding unit prevents a restored supply to a disconnected supply system.

In order to guarantee that only the load side of the isolating module is short-circuited, an embodiment of the invention includes grooves on the isolating and grounding units which correspond to coding ribs on the housing of the isolating module.

An embodiment of the present invention includes means for providing a message signal through an auxiliary circuit whenever the isolating or grounding unit is removed from the isolating module. This indicates the presence or absence of the isolating unit or the grounding unit. This auxiliary circuit is operated by a projection formed on the isolating or grounding unit.

DETAILED DESCRIPTION

Figure 2:
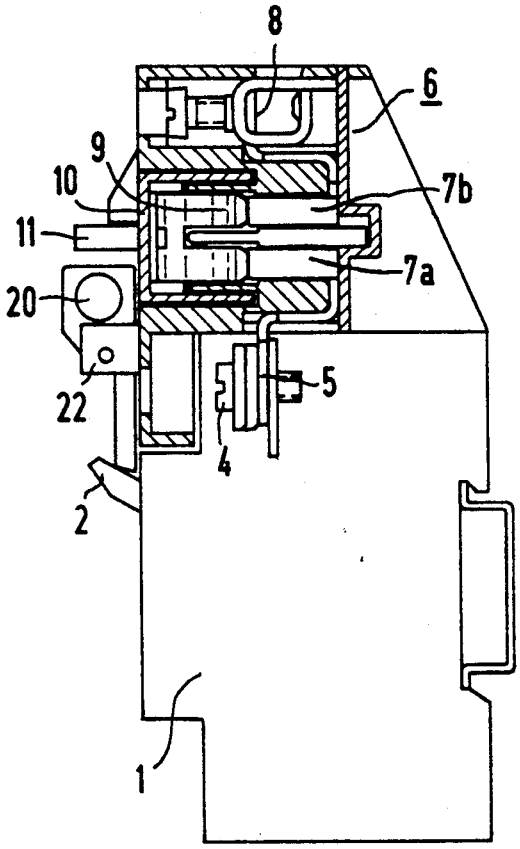
FIG. 2 is a partial sectional view taken along the line II—II of FIG. 1.
Figure 1:
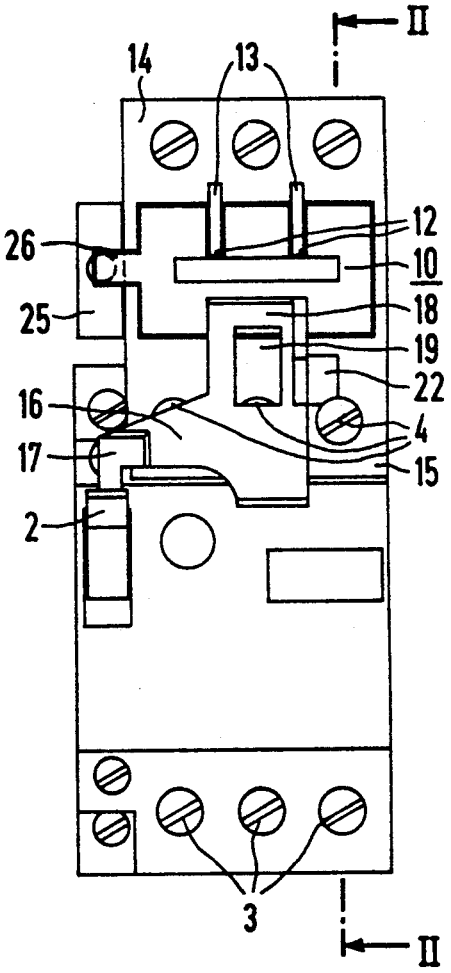
FIG. 1 shows a top view of a circuit breaker with an attached auxiliary circuit and isolating module, constructed in accordance with an embodiment of the present invention.

Referring to FIGS. 1 and 2, a rectangular circuit breaker 1 of the present invention has a toggle 2 for switching on and off the circuit breaker 1. The circuit breaker 1 includes a short-circuit tripping device and a bimetal tripping device (not shown), along with a corresponding breaker mechanism. The circuit breaker 1 has a conventional trip-free mechanism so that the toggle 2 does not have to be moved when the circuit breaker 1 is tripped. Output coupling terminals for output lead wires have a reference numeral 3 and input coupling terminals for input lead wires have a reference numeral 4. Terminal posts 5 of an isolating module 6 are received under the input coupling terminals 4. The terminal posts 5 end in blade-shaped contacts *7a*. Box terminals 8 end in blade-shaped contacts *7b*, and are coupled to a supply line (not shown). The blade-shaped contacts *7a*, *7b* lying opposite each other are coupled by lyre-shaped contact bridges 9. The contact bridges 9 are installed in an isolating unit 10.

Figure 4:
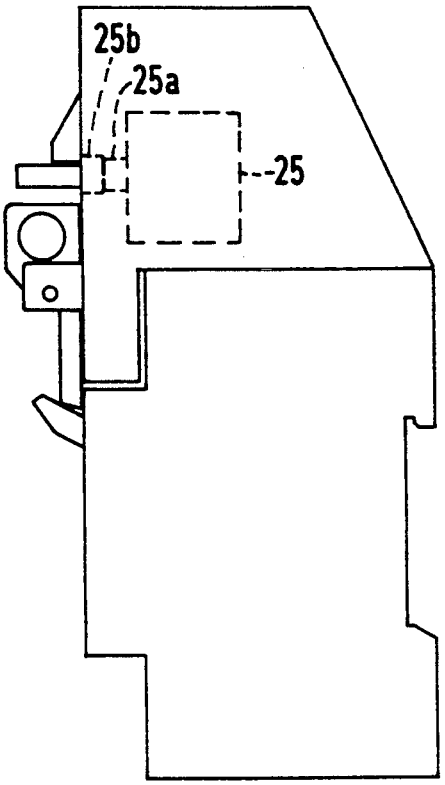
FIG. 4 is a lateral view of a circuit breaker with an attached auxiliary circuit and isolating module in a switched-on and interlocked condition.
Figure 3:
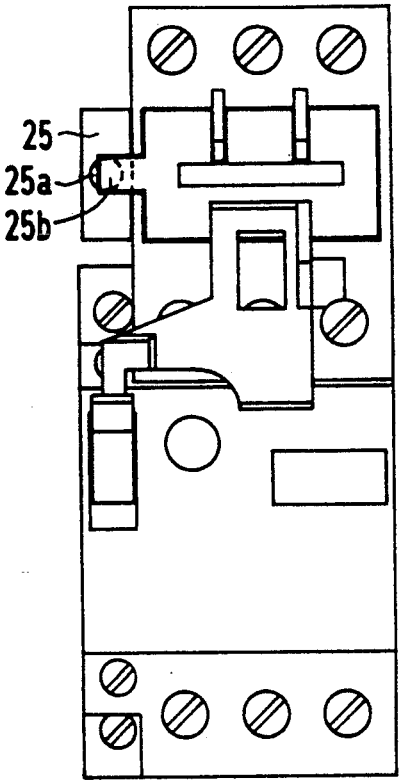
FIG. 3 is a top view similar to FIG. 1 of a circuit breaker with an attached auxiliary circuit and isolating module in a switched-on and interlocked condition.
Figure 6:
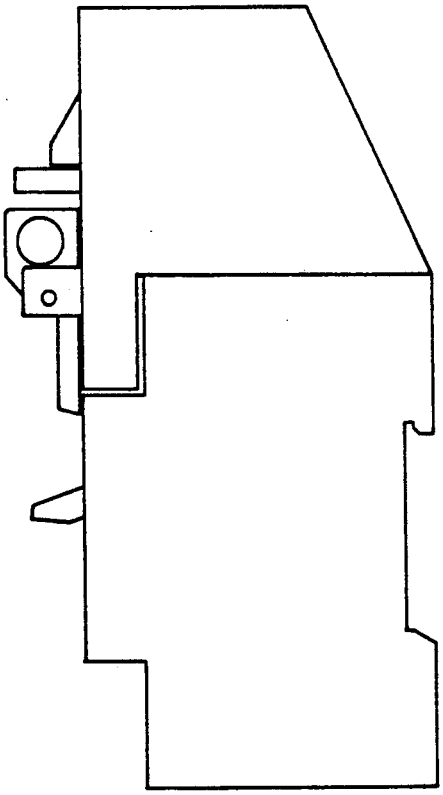
FIG. 6 is a lateral view similar to FIG. 4, showing a circuit breaker with an attached isolating module in a switched-off and interlocked condition.
Figure 5:
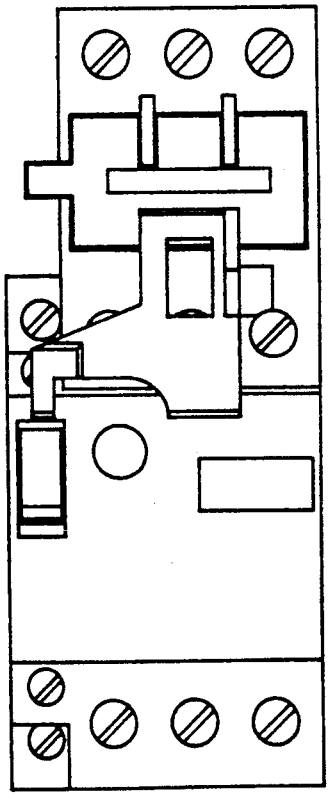
FIG. 5 is a top view similar to FIG. 3, showing a circuit breaker with an attached isolating module in a switched-off and interlocked condition.
Figure 8:
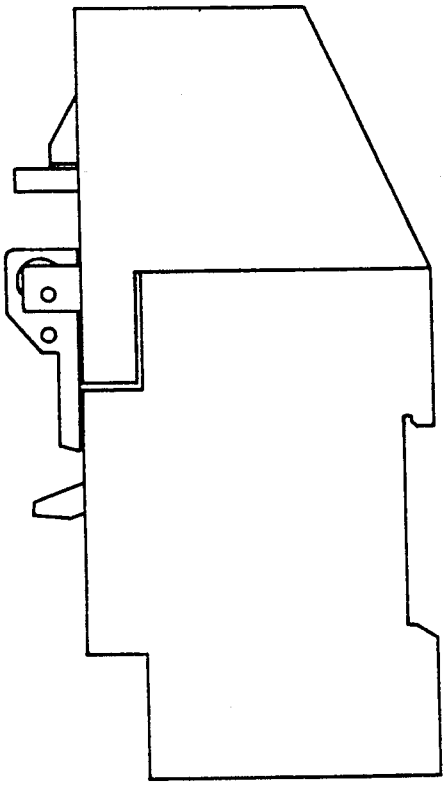
FIG. 8 is a lateral view similar to FIG. 4, showing a circuit breaker with an attached isolating module in a switched-off and released/unlocked condition.
Figure 7:
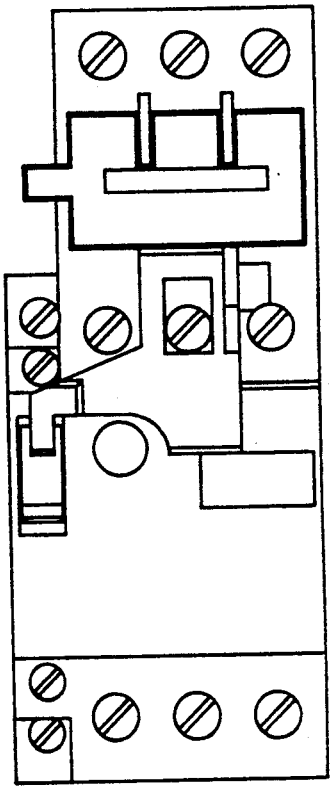
FIG. 7 is a top view similar to FIG. 3, showing a circuit breaker with an attached isolating module in a switched-off and released/unlocked condition.
Figure 10:
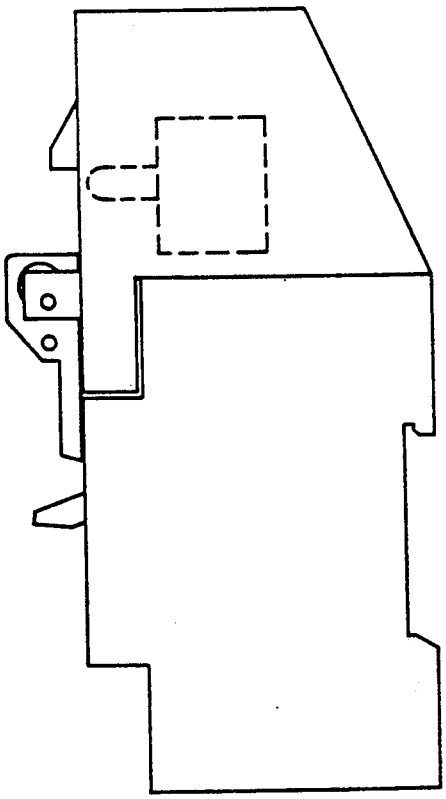
FIG. 10 is a lateral view similar to FIG. 4, of a circuit breaker with an isolating unit removed in a switched-off, released/unlocked condition. Removal of the isolating unit is announced by the auxiliary circuit.
Figure 9:
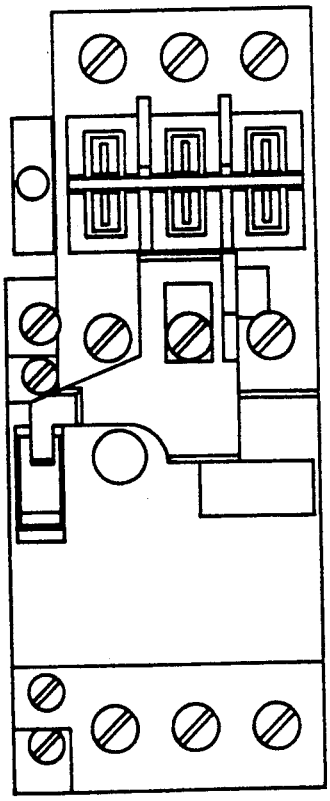
FIG. 9 is a top view similar to FIG. 3, of a circuit breaker with an isolating unit removed in a switched-off, released/unlocked condition. Removal of the isolating unit is announced by the auxiliary circuit.

The isolating unit 10 has a handle 11 for removal from the isolating module 6 and slot-shaped grooves 12 which are adapted to receive coding ribs 13 on a housing 14 of the isolating module 6. This ensures that the isolating unit 10, and particularly the grounding unit (shown in FIGS. 13 and 14), can be inserted only in a specified position and also ensures that the contact bridges 9 can be connected to the blade-shaped contacts *7a*, *7b*. The isolating module 6 includes an auxiliary circuit 25, better seen in FIGS. 3 and 4. It includes a projecting switch actuator 25*a* which is contacted by a projection 25*b* on the isolating unit 70. By removal of the isolation unit or grounding unit 23, the formed-on projection releases the actuator of the auxiliary circuit 25. Thus, the auxiliary circuit contacts are made and an announcement takes place.

As FIGS. 1 and 2 illustrate, the circuit breaker 1 is recessed in a step-wise fashion near the coupling terminals 3 and 4. An attachment 15 on the housing 14 having openings to access the input coupling terminals 4 extends into this region.

A slidable locking bar 16 is mounted on the housing 14. The locking bar 16 functions interdependently both with the toggle 2 (by means of an extension 17) and the isolating unit 10 (by means of an attachment 18). Furthermore, there is an opening 19 in the locking bar 16. When the circuit is disconnected (i.e., the toggle 2 is located in the position shown in FIGS. 7–10), the opening 19 exposes the input coupling terminals 4 so that these terminals 4 can be operated and the isolating module 6 either removed from the circuit breaker 1 or mounted onto it.

As FIGS. 1 and 2 demonstrate, when the circuit breaker 1 is in a switched-on state, the locking bar 16 lies above the isolating unit 10 so that the isolating unit 10 cannot be removed. To secure the installed isolating unit 10, the locking bar 16 is brought by means of the toggle 2 from the position shown in FIGS. 7–10 into the position shown in FIGS. 3–6. When the locking bar 16 is brought into the position shown in FIGS. 7 and 8, the isolating unit 10 can be removed.

Figure 12:
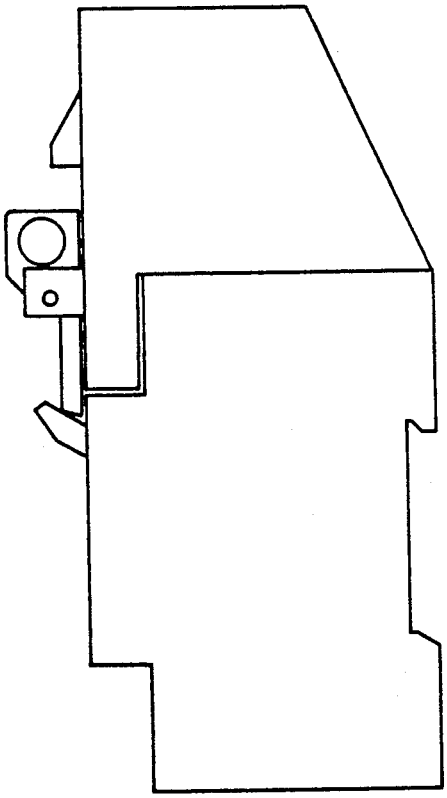
FIG. 12 is a lateral view similar to FIG. 4, showing a circuit breaker with an isolating unit removed in an interlocked condition.
Figure 11:
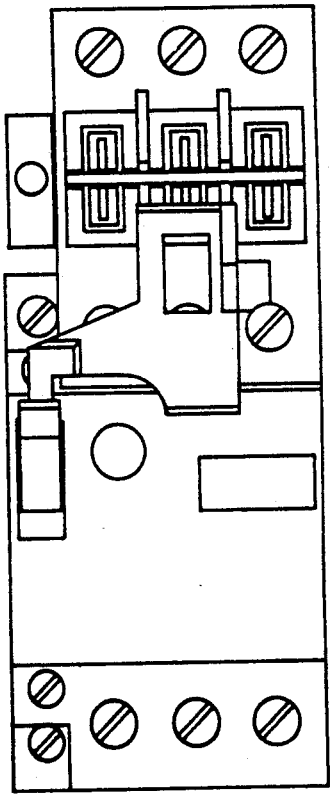
FIG. 11 is a top view similar to FIG. 3, showing a circuit breaker with an isolating unit removed in an interlocked condition.

Although the locking bar 16 can also be brought into the position shown in FIGS. 11 and 12 when the isolating unit 10 is removed and the circuit breaker 1 is connected, current cannot be conducted between the input and output coupling terminals 8 and 5 of the isolating module 6.

Figure 17:
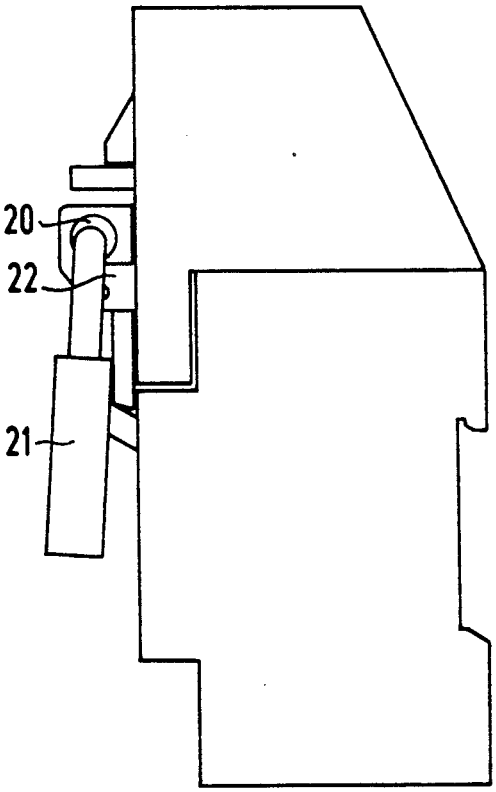
FIG. 17 is a lateral view of a circuit breaker in which a bolt is secured by a padlock to prevent removal of an isolating module or grounding unit.
Figure 16:
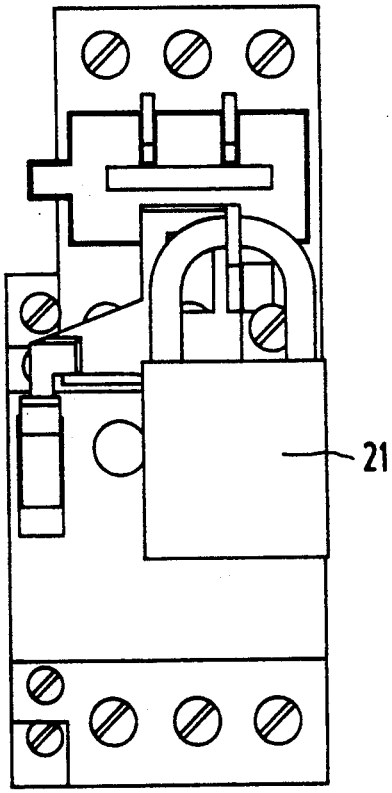
FIG. 16 is a top view of a circuit breaker in which a bolt is secured by a padlock to prevent removal of an isolating module or grounding unit.

In order to prevent unauthorized removal of the isolating module 6 (FIG. 2), the locking bar 16 has a perforation 20 (FIGS. 2 and 17) through which a padlock 21 with a U-bolt can be secured (FIGS. 16 and 17). Movement of the locking bar 16 is prevented by interaction with a corresponding projection 22 on the housing 14.

It is possible to establish a visible isolating gap with the circuit breaker 1 of the present invention (c.f., FIGS. 9 and 11) as is needed. Instead of modifying the actual circuit breaker 1, it is only necessary to couple the isolating module 6 to the input coupling terminals 4 and to remove the isolating unit 10 in the earlier described manner. The isolating module 6 can be provided separately from the circuit breaker 1 as a supplemental module to be purchased as needed.

Figure 14:
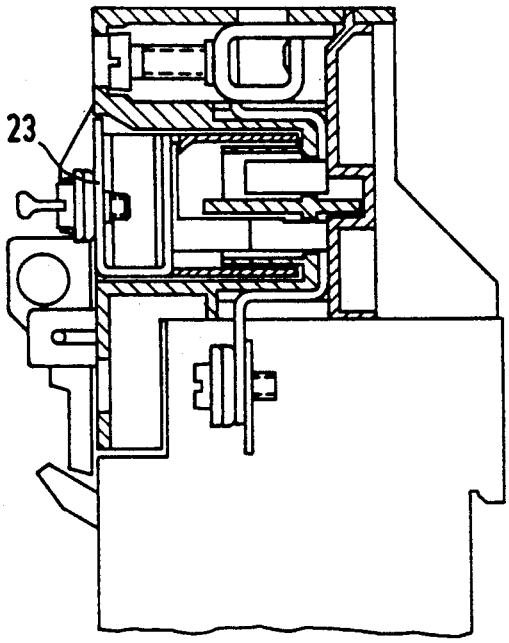
FIG. 14 is a sectional view of an embodiment of a circuit breaker of the present invention with an installed grounding unit and auxiliary unit.
Figure 13:
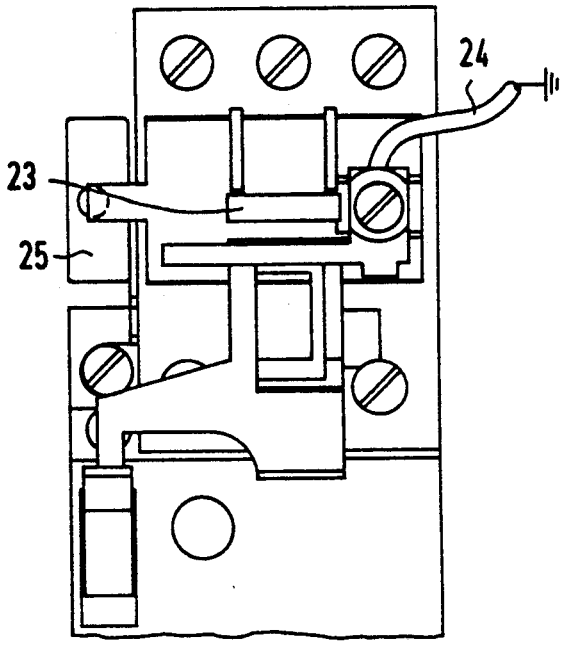
FIG. 13 is a top view of an embodiment of a circuit breaker of the present invention with an installed grounding unit and auxiliary unit.
Figure 15:
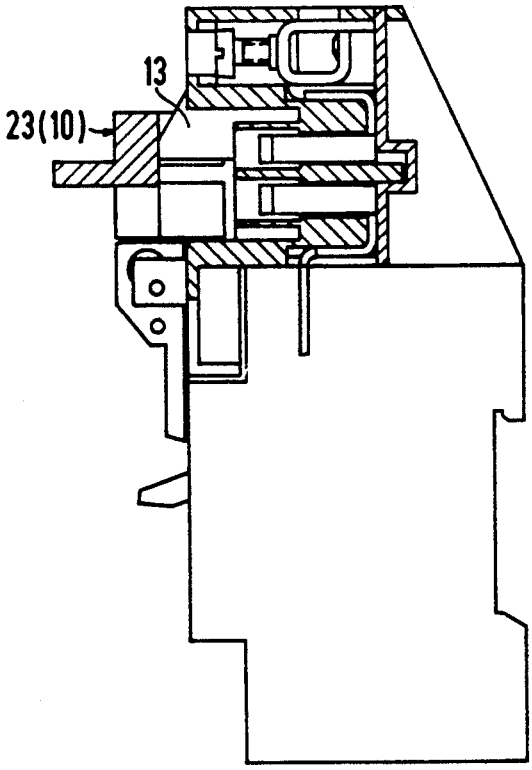
FIG. 15 is a sectional view of an embodiment of a circuit breaker with a grounding or isolating unit installed in reverse such that coding ribs prevent the erroneous installation of a grounding unit.

A grounding unit 23 can also be installed in place of the isolating unit 10, with the terminal posts 5 on the load side being short-circuited via the blade-shaped contacts *7a* and coupled to ground via a ground wire 24 (FIGS. 13, 14). FIG. 15 is a lateral view of the circuit breaker illustrating how the coding ribs 13 prevent the erroneous installation of a grounding unit 23 or isolation unit 10.

What is claimed is:

1. An apparatus to provide a manually operable circuit breaker with a visible isolating gap comprising:

a) a manually operable circuit breaker with connecting terminals, said breaker having open and closed states;

b) an isolating module including a base portion and a removable isolating unit, said base portion having extensions connected to said connecting terminals; and c) means for:

i) preventing removal of said removable isolating unit when said circuit breaker is closed; and ii) preventing access to at lest one of said connecting terminals to which one of said base portion extensions is connected when said circuit breaker is closed.

2. Apparatus according to claim 1, wherein said isolating unit includes a contact bridge electrically coupling contacts disposed in said isolating module when said isolating unit is inserted in said isolating module.

3. Apparatus according to claim 2, wherein said circuit breaker includes a manually operated element and said means for preventing include a bolt operatively coupled to said manually operated element and functioning interdependently with said isolating module, said isolating unit, and connecting terminals.

4. Apparatus according to claim 1, wherein said circuit breaker includes a manually operated element and said means for preventing include a bolt operatively coupled to said manually operated element and functioning interdependently with said connecting terminals.

5. Apparatus according to claim 4, wherein said manually operated element is a toggle and said bolt is a slidable locking bar having recesses for providing access to said coupling terminals.

6. Apparatus according to claim 3, wherein said manually operated element is a toggle and said bolt is a slidable locking bar having recesses for providing access to said coupling terminals.

7. Apparatus according to claim 6, further comprising means for locking said bolt.

8. Apparatus according to claim 5, further comprising means for locking said bolt.

9. Apparatus according to claim 4, further comprising means for locking said bolt.

10. Apparatus according to claim 3, further comprising means for locking said bolt.

11. An apparatus to provide a manually operable circuit breaker with a visible isolating gap comprising:

a) a manually operable circuit breaker with connecting terminals, said breaker having open and closed states;

b) an isolating module including a base portion and a removable grounding unit, said base portion having extensions connected to said connecting terminals; and c) means for:

i) preventing removal of said removable grounding unit when said circuit breaker is closed; and ii) preventing access to at lest one of said connecting terminals to which one of said base portion extensions is connected when said circuit breaker is closed.

12. Apparatus according to claim 11, wherein said circuit breaker includes a manually operated element and said means for preventing include a bolt operatively coupled to said manually operated element and functioning interdependently with said isolating module, said grounding unit, and said connecting terminals, and further comprising means for locking said bolt.

13. Apparatus according to claim 12, wherein said manually operated element is a toggle and said bolt is a slidable locking bar having recesses for providing access to said coupling terminals.

14. Apparatus according to claim 12, wherein said grounding unit includes a contact bridge and said manually operated element is a toggle and said bolt is a slidable locking bar having recesses for providing access to said coupling terminals.

15. Apparatus according to claim 14, wherein said grounding unit has grooves, and said base of said isolating module has a housing with coding ribs corresponding to said grooves.

16. Apparatus according to claim 13, wherein said grounding unit has grooves, and said base of said isolating module has a housing with coding ribs corresponding to said grooves.

17. Apparatus according to claim 12, wherein said grounding unit has grooves, and said base of said isolating module has a housing with coding ribs corresponding to said grooves.

18. Apparatus according to claim 11, wherein said grounding unit and has grooves, and said base of said isolating module has a housing with coding ribs corresponding to said grooves.

19. Apparatus according to claim 11, further comprising an auxiliary switch providing an announcement signal when said grounding unit is removed from said isolating module.

20. Apparatus according to claim 1, further comprising an auxiliary switch providing an announcement signal when said isolating unit is removed from said isolating module.

* * * * *